US005537724A

United States Patent [19]

Chou

[11] Patent Number: 5,537,724

[45] Date of Patent: Jul. 23, 1996

[54] ORNAMENTAL CLIP

[76] Inventor: Kuo-Hua Chou, Suite 1, 11 F, 95-8 Chang Ping Road, Sec. 1, Taichung, Taiwan

[21] Appl. No.: 409,930

[22] Filed: Mar. 23, 1995

Related U.S. Application Data

[63] Continuation of Ser. No. 89,167, Jul. 9, 1993, abandoned.

[51] Int. Cl.[6] ..... A44B 21/00

[52] U.S. Cl. ..... 24/530; 24/562; 132/145; 132/279

[58] Field of Search ..... 24/11 F, 530, 458, 24/545, 562; 132/276, 278–280, 145

[56] References Cited

U.S. PATENT DOCUMENTS

| | | | |
|---|---|---|---|
| 1,670,970 | 5/1928 | Lawerdiere | 132/276 |
| 1,696,183 | 12/1928 | Bassett | 24/11 F |
| 2,037,408 | 4/1936 | Deli | 24/11 F |
| 2,100,825 | 11/1937 | Wehz | 24/530 |
| 2,491,934 | 2/1949 | Solomon | 132/278 |
| 3,950,823 | 4/1976 | Schreter | 24/562 X |

FOREIGN PATENT DOCUMENTS

| | | | |
|---|---|---|---|
| 463644 | 2/1914 | France | 24/530 |
| 256244 | 8/1978 | Switzerland | 24/11 F |

*Primary Examiner*—James R. Brittain

[57] ABSTRACT

An ornamental clip comprises generally a flat conical base and an elastic plate coupled on their corresponding ends thereof. The base has an intermediate corrugated rectangular plate in different curvature disposed into a longitudinal recess along the length of its center line and a square socket formed at the flat end thereof including a horizontal slot and a pair of rectangular recesses on upper portion. The elastic plate has a elongate elliptical recess formed along its longitudinal center line, a pair of three-point elastic centers respectively pressed adjacent the two ends of the elliptical recess and a rectangular plug formed at the flat end having a pair of spaced rectangular spring snap catches formed on longitudinal center line for a readily connection of the rectangular plug with the square socket in a snap fitting. There are several modified examples and an interlocking structure based on this ornament clip. The characteristic of this disclosure is to provide a structurally improved ornamental clip which is readily assembled, durable and broadly adaptable to most ornamental object.

5 Claims, 8 Drawing Sheets

ORNAMENTAL CLIP

BACKGROUND OF THE INVENTION

This is a continuation application of U.S. patent application Ser. No. 08/089,167, filed Jul. 9, 1993, now abandoned.

The present invention relates to clips, more particularly to a structurally improved ornamental clip which is applicable to a brooch, a hair pin, a tiepin or cuff links. The ornamental clip of the present invention consumes less material and is ready to assemble during the manufacturing stage.

Prior art ornamental clips are most likely composed of a pair of sizably similar rectangular plates, an intermediate torsional spring and an axial pin. A lug is formed near one end of the first rectangular plate with a pair of axial apertures punched thereon the lateral prongs of the lug for securing the axial pin therein. A hinge jaw and a thumbpiece are respectively formed on two ends of the second rectangular plate. The pair of rectangular plates are hinged by the axial pin together with the torsional spring therebetween which provides sufficient torque force against the second rectangular plate when the first plate is in the closed position. However, it reveals the following disadvantages:

1) when one inserts the axial pin into one of the pair of axial apertures on the prongs of the lug and the hinge jaw on the second rectangular plate together with the torsional spring during assembly, the operator has to overcome a strong resilient force from the torsional spring such that is difficult for him to insert the axial pin into the other aperture before he is skillfully able to balance against the resilient force. Besides, the ends of the axial pin have to be pressed to a flattened portion on the outer periphery of the prongs for a stable securing on the lug. These complicated and difficult processes are of a great structural defficiency of the prior art, 2) the clipping force is uneven on the second rectangular plate because it does not come from a direction vertical to the plate plane but a torque force from one end of the plate, which constitutes a structure leverage phenomenon that the clipping force is concentrated to other end of the plate. It presents another structural difficiency for the prior art, and 3) once the torque force lessens because of the mental fatigue of the tortional spring, the clip will become useless. Besides, it has a structural limitation and cannot be broadly applied to ornamental objects such as a brooch, a tiepin or cuff-links.

SUMMARY OF THE PRESENT INVENTION

The main object of the present invention is to provide an ornamental clip which has been structurally improved and materially simplified to readily facilitate a assembly.

Another object of this invention is to provide an ornamental clip in a structure which can be broadly applied to a brooch, a hair clip, a tiepin or cuff links.

Accordingly, the present invention of an ornamental clip comprises generally a flat conical base and a corresponding elastic plate; The conical base has a round head having attached on the under side a semi-circular member, a longitudinal slot formed along the length of its center line being secured on two ends with a corrugated rectangular plate which is bent into five continuous archs in different curvatures and a square socket integrally formed on the flat end which is projected from the upward surface of the conical base with a horizontal slot formed along the axial direction and a pair of spaced rectangular recesses formed along the longitudinal center line of the upper housing of the square socket. The elastic plate has on the flat end a rectangular plug which is made in registry with the square socket on the conical base and is volumetrically equal to the horizontal slot. A pair of rectangular spring snap catches are spaced along the longitudinal center line on the upper surface of the plug and positioned in registry with the pair of spaced rectangular recesses on the upper portion of the square socket. The rectangular plate has also a pair of cutaway corners made intentionally to readily permit insertion of the plug into the socket. A transitional portion is formed between the rectangular plug and the main body of the elastic plate and is bent upwardly and then horizontally in order that the upper surface of the elastic plate can be elevationally equal to the surface plane of the square socket and a grasping space can be defined in between the conical base and the elastic plate. Furthermore, an elongated elliptical recess is axially formed along the length of the longitudinal center line of the elastic plate with a three-point elastic center pressed at each end of the elliptical recess to provide adequate resilience to the lateral arms aside the elliptical recess.

When the elastic plate is inserted via the rectangular plug into the horizontal slot on the square socket of the conical base, the pair of spaced rectangular spring snap catches are first pressed downwardly by the upper portion of the socket and then spring upward and catch into the pair of the spaced rectangular recesses on the upper portion of the socket in a snap fitting. The elastic plate is normally in a state of the first stability before clipping an object and will resile downwardly under an external pressure, therefore firmly stopping against the top surface of the conical base.

The ornamental clip of this invention can structurally combine with more than one clip together to form a larger dimensional equivalent for different requirements and there are several modified examples which will become apparent in a consideration of the following detailed description and attached drawings.

DETAIL DESCRIPTION OF THE PREFERRED EMBODIMENT OF THE PRESENT INVENTION

Figure 2:
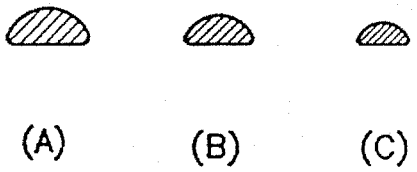
FIGS. 2(A)–(C) are sectional views showing corresponding longitudinal sections of the corrugated rectangular plate.
Figure 1:
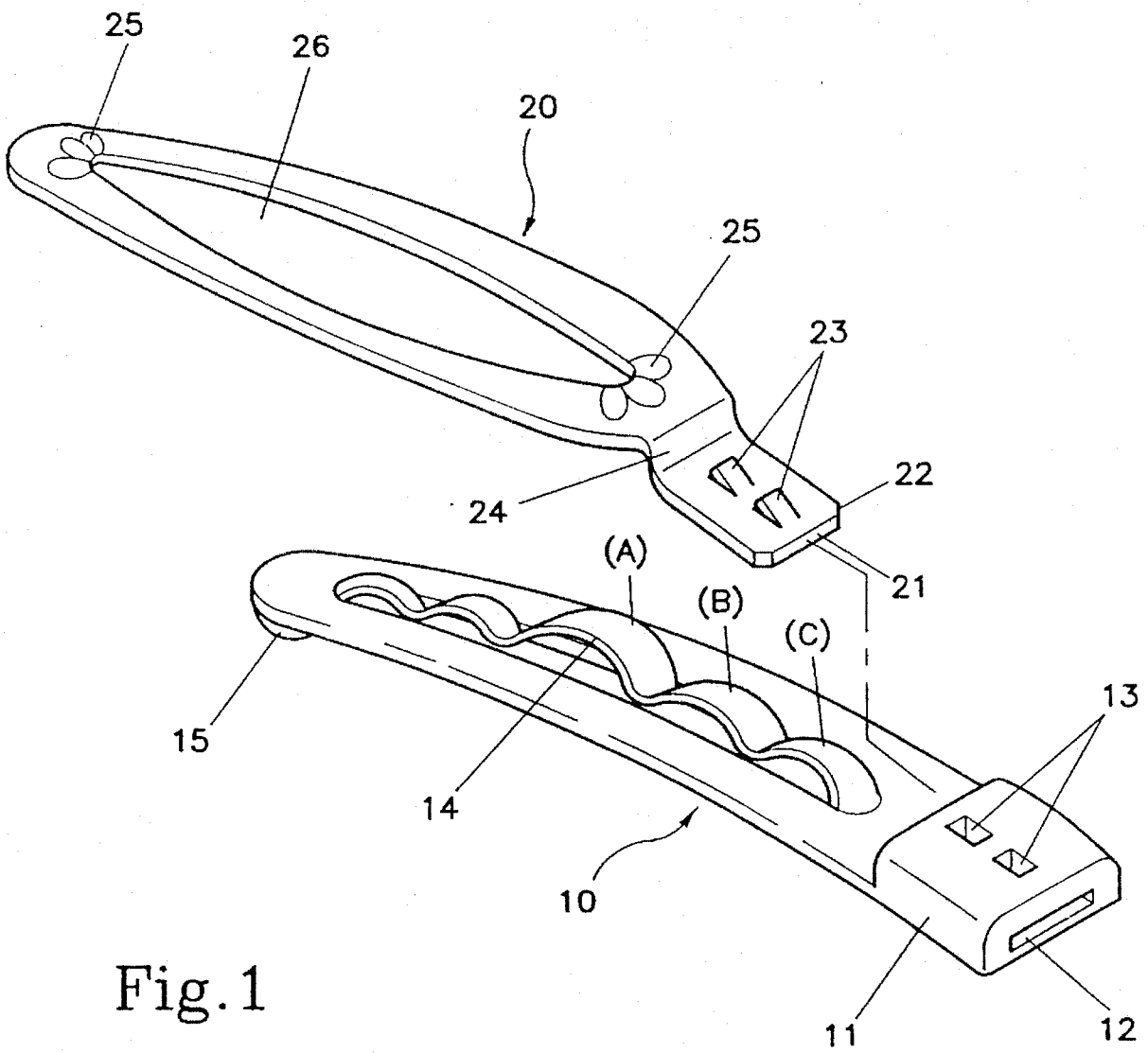
FIG. 1 is an exploded perspective view to show a preferred embodiment according to the present invention.

Referring to FIG. 1, the present invention of an ornamental clip comprises generally a flat conical base 10 and a corresponding elastic plate 20. The flat conical base 10 has a round head having attached on the under side a semi-circular member 15 which has a glossy surface to prevent human skin from injury, a corrugated rectangular plate 14 disposed on two ends into the respective ends of a longitudinal slot formed along the length of the center line of the conical base 10 and a square socket 11 integrally formed on the flat end of the conical base 10 having a horizontal slot 12 formed along the longitudinal direction of the base and a pair of spaced rectangular recesses 13 formed along the axial center line of the upper portion of the square socket 11 which is projected upwardly from the top surface of the base 10. The corrugated plate 14 has continuous archs in different curvatures (see FIG. 2). The middle arch (A) which is the largest one among others has the largest sectional area. Sequentially the pair of archs (B) adjacent to the arch (A) have their sectional areas smaller than that of arch (A) and archs (C) at the two ends of the corrugated plate 14 have the smallest sectional area among the others. The elastic plate 20 has integrally formed on the flat end a rectangular plug 21 insertable within the square socket 11 on the flat end of the conical base 10, having a pair of spaced rectangular spring snap catches 23 along the longitudinal center line on the top surface of the plug 21 and a pair of cutaway corners 22 which is formed to facilitate a smooth insertion of the plug 21 into the square socket 11, a transitional portion 24 formed between the rectangular plug 21 and the main body of the elastic plate 20 by two bends first upward and then forward so that the planar level of the elastic plate 20 would higher than that of its rectangular plug 21 and equal to the upper surface of the square socket 11 in order to define a grasping space therein between the elastic plate 20 and the conical base 10, and an elongated elliptical recess 26 formed along the length of the longitudinal center line of the elastic plate 20 with a pair of the three-point elastic centers 25 press formed into dimples at two end of the elliptical recess 26 to provide adquate resilience to the lateral arms of the elastic plate 20.

Figure 3:
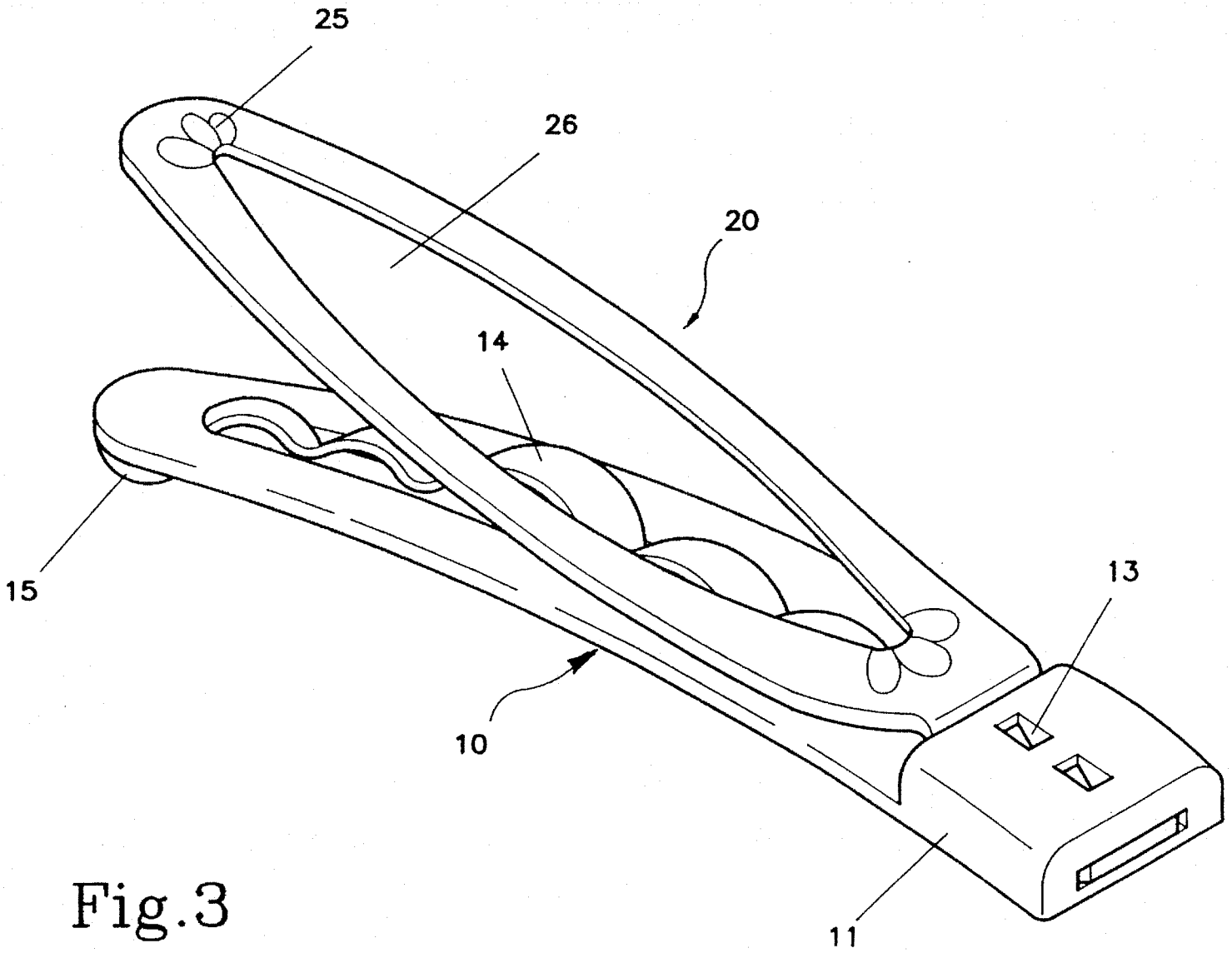
FIG. 3 is a perspective view to show an assembled ornamental clip of the preferred embodiment according to the present invention.

Referring to FIG. 3, when the elastic plate 20 is assembled with the conical base 10 by the rectangular plug 21 being inserted into the horizontal slot 12 of the square socket 11, the pair of spaced rectangular spring snap catches 23 are first pressed downwardly by the upper portion of the square socket 11, then spring upward and catch into the pair of spaced rectangular recesses 13 of the socket 11 in a snap fitting. The rear side of the transitional portion 24 is stopped against the fore side of the square socket 11. Before the ornamental clip is clipped with a certain object, the elastic plate 20 normally remains in a state of the first stability (as shown in FIG. 3). It will resile downwardly under an external pressure to a second stability to firmly grasp an object with the top surface of the conical base 10.

Figure 4:
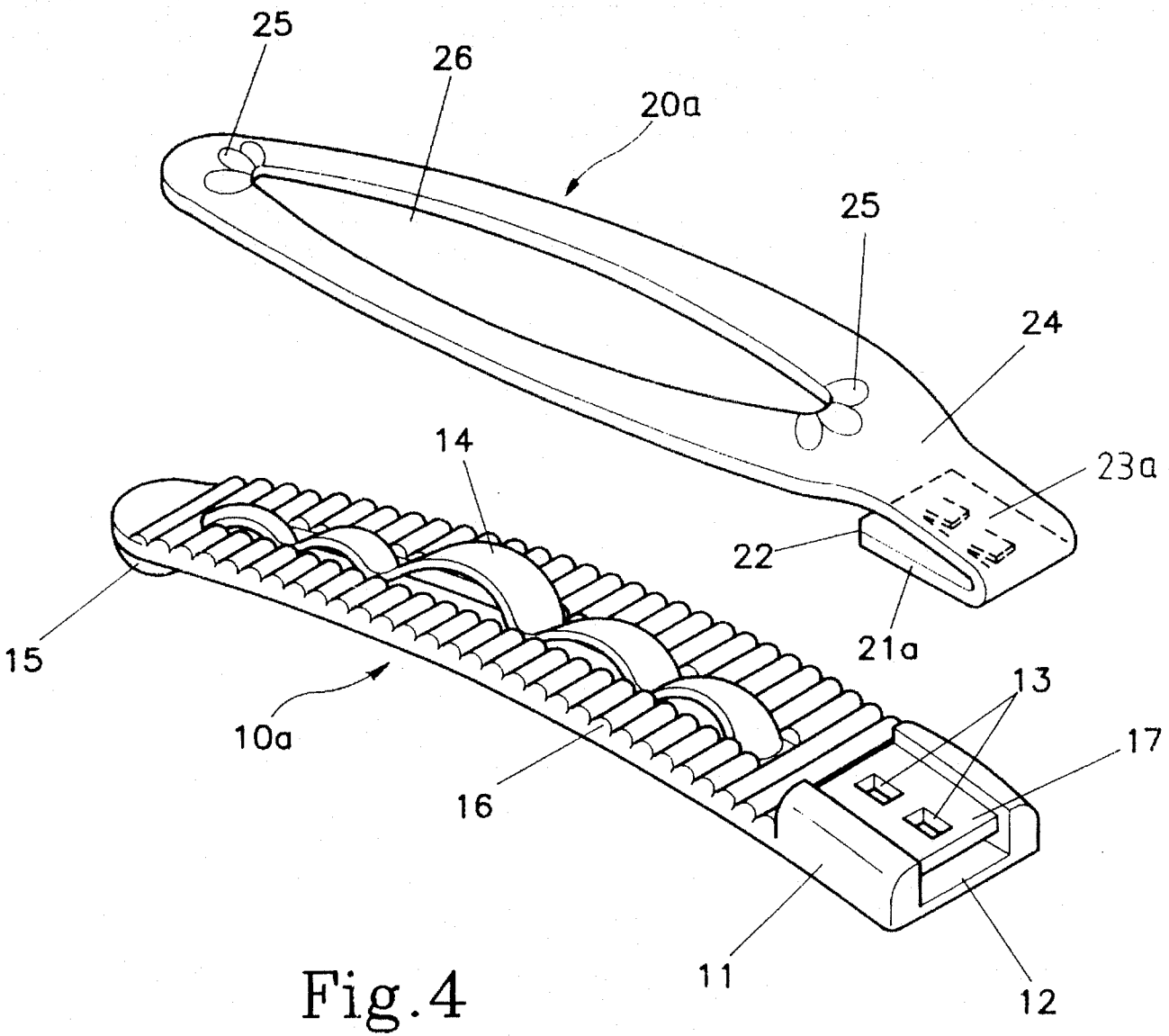
FIG. 4 is a perspective view to show a second example of the preferred embodiment according to the present invention.

Referring to FIG. 4, showing a second example of this invention conprises a flat conical base **10*a* which is a modification of the previous example by reforming the planar top surface of the conical base 10 into a regularly ridged surface to provide additional friction to grasp an object and slightly recessing the upper portion of the square socket 11 to form a rectangular concavity 17 dimensionally equal to the upper portion of a hook shaped plug 21*a* which is a modification of the rectangular plug 21 at the flat end of the elastic plate 20 which is now referred to 20*a* in FIG. 4. The plug 21*a* is made by flattening the transitional portion 24 and elongating the end portion of the elastic plate 20, then bending the plug 21 first downwardly and then backwardly to form the hook shaped plug 21*a*. The pair of rectangular spring snap catches 23 on the rectangular plug 21 are now moved to the opposite side on the plug 21*a* for reforming a pair of snap catches 23*a* which are positionally in registry with the pair of rectangular recesses 13 on the upper portion of the square socket 11. To assemble the elastic plate 20*a* with the conical base 10*a* one inserts the hook shaped plug 21*a* into the horizontal slot 12 from the rear side of the square socket 11 so that the pair of spring snap catches 23*a* will be trapped in the pair of rectangular recesses 13 in a snap fitting. The upper portion of the plug 21*a* will stop in the rectangular concavity 17 on the upper portion of the square socket 11**.

Figure 5:
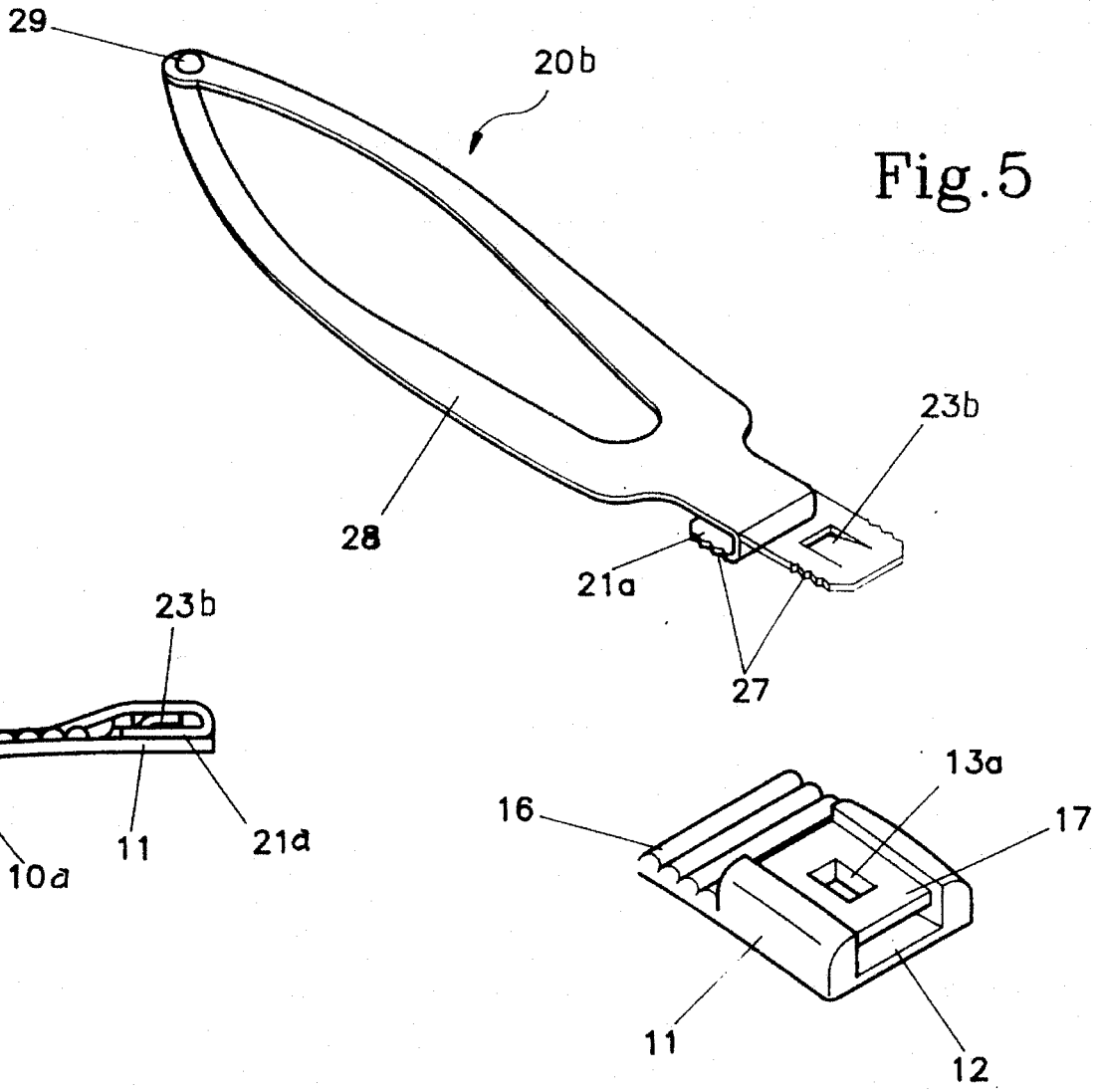
FIG. 5 is a perspective view to show a third example of the preferred embodiment according to the present invention.
Figure 6:
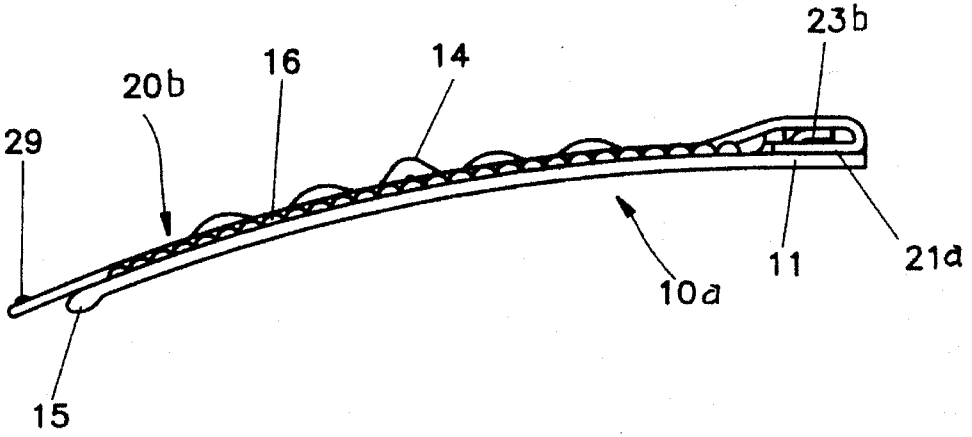
FIG. 6 is a longitudinal sectional view of FIG. 5, FIG. 7 and 7A are of a perspective view and a sectional view to show a combined structure of FIG. 1.

Referring to FIG. 5, showing a third example of this invention which is a modified structure of the second example. A single larger rectangular recess **13*a* is formed instead of the pair of spaced rectangular recesses 13 along the longitudinal center line on the upper portion of the square socket 11. The pair of spaced rectangular spring snap catches 23*a* are replaced, by a single larger rectangular spring snap catch 23*b* on the central portion of the hook shaped plug 21*a* on which lateral sides are reformed into serrated edges 27 so as to provide sufficient friction to plug 21*a* when assembling. The main body of the elastic plate 20*a* is reformed herein into an elastic plate 20*b* by a pair of parallel extended flat arms 28 instead of the elongated elliptical recess 26 and the pair of the three-point elastic centers 25 on the previous examples. The pair of parallel extended flat arms 28 are stressedly joined on their round ends and secured by a rivet 29 so as to provide adequate resilient stress for the newly formed elastic plate 20*b*. FIG. 6 shows an assembled ornamental clip of the third example when the elastic plate 20*b*** is in closed position.

Figures 7, 7A:
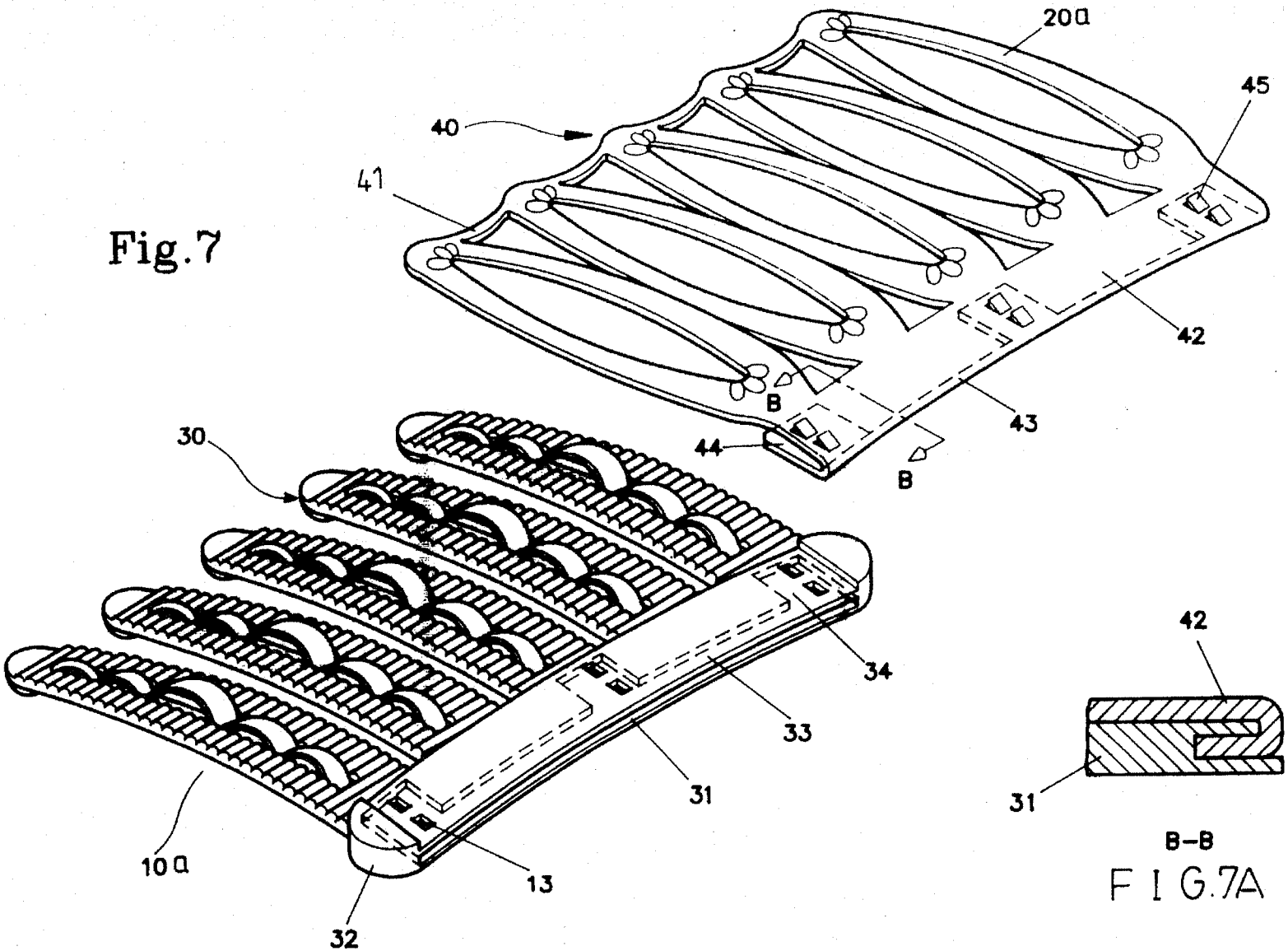

Referring to FIG. 7 showing a fourth example of the present invention in which an interlocking ornamental clip is combined with a plurality of clips of the second example. A transversely elongate rectangular socket 31 is made instead of the square sockets 11 on the flat end of the conical bases **10*a*. The elongated rectangular socket 31 has a semi-circular member 32 projected upwardly on each end of the socket 31, three pairs of spaced rectangular recesses 13 spacedly disposed on the upper portion of the rectangular socket 31 and an elongate slit 33 formed along the outward edge of the socket 31 in communication with the three rectangular cavities 34 which are further extended inwardly inside the socket 31 and located directly under the pairs of spaced rectangular recesses 13. A plurality of the conical bases 10*a* are spacedly connected on their flat end onto the inward edge of the rectangular socket 31, whereby an interlocking base 30 is therefore constructed. An interlocking elastic plate 40 incorporating the base 30 is a combination of a plurality of the elastic plates 20*a* which are laterally connected on their round heads with rectangular flat members 41 and parallel connected on their flat ends with an elongated hook shaped plug 42 which has three rectangular plugs 44 spacedly connected with an inwardly curved incurvated flange 43 and extend inwardly. A pair of spaced rectangular spring snap catches 45 are formed on the central portions of the plugs 44. A sectional diagram of FIG. 7A which is taken along B—B of FIG. 7 shows a firm connection of the elongated rectangular plug 42 with the elongated socket 31** when assembled.

Figure 8:
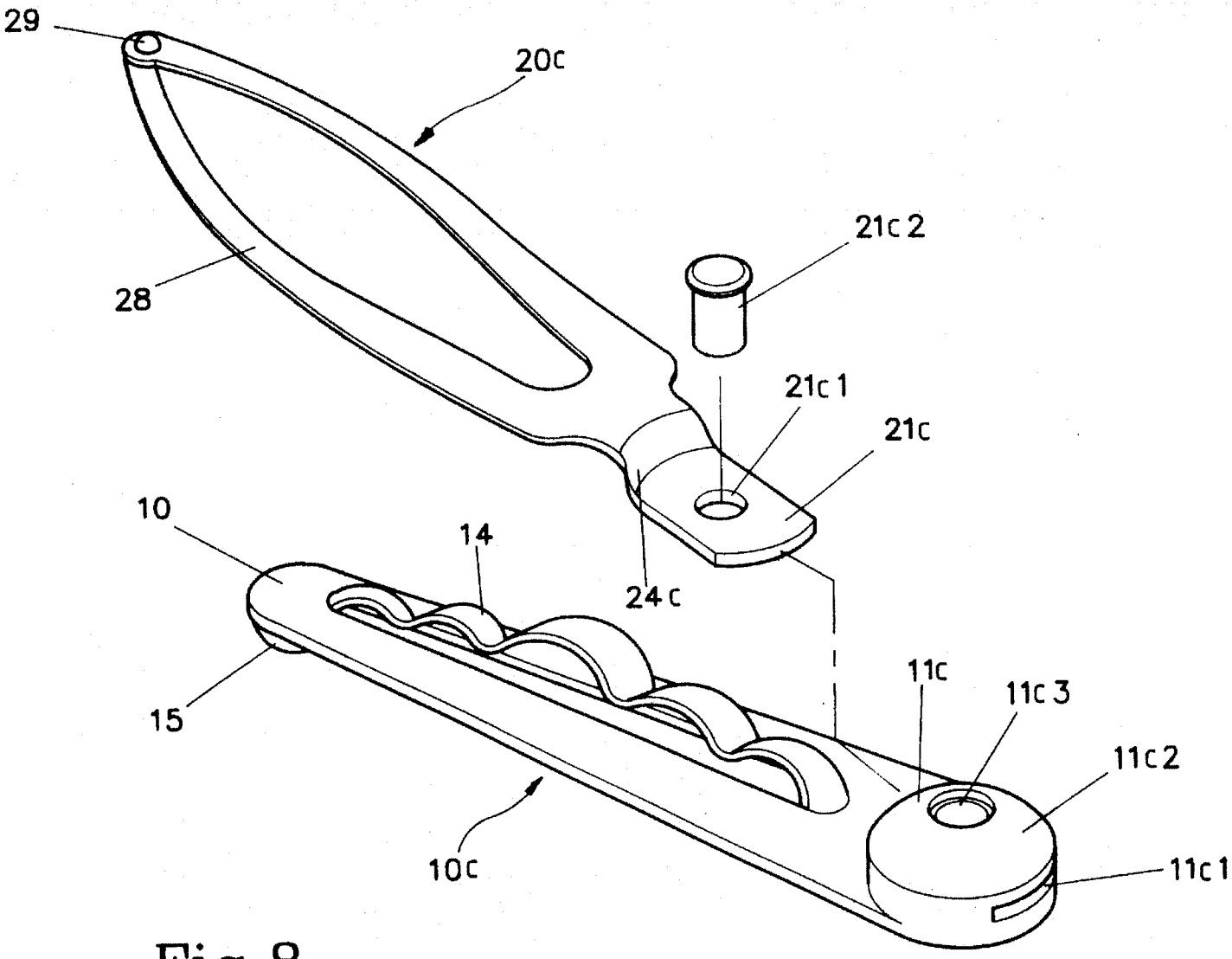
FIG. 8 is a perspective view to show a fourth example of the preferred embodiment according to the present invention.

Referring to FIG. 8 a fifth example of this invention comprises a generally flat conical base 10*c* which is a modification of the flat conical base 10 of the first example by integrally forming a circular socket 11*c* on the flat end instead of the square socket 11 and an elastic plate 20*c* which is a modification of the elastic plate 20*b* of the third example by integrally forming a transitional portion 24*c* and a simplified flat rectangular plug 21*c* instead of the hook shaped plug 21*a*. The circular socket 11*c* has a horizontal slot 11*c*1 following the longitudinal direction of the base 10*c*, a dome upper portion 11*c*2 and a round hole 11*c*3 at the top center of the dome 11*c*2 through the socket 11*c*. The flat rectangular plug 21*c* has equally a round hole 21*c*1 made in registry with the round hole 11*c*3 on the circular socket 11*c* and a rivet 21*c*2. The elastic plate 20*c* is assembled with the flat conical base 10*c* on the flat rectangular plug 21*c* inserted, into the horizontal slot 11*c*1 of the circular socket 11*c* and fastened through the round holes 11*c*3 and 21*c*1 by the rivet 21*c*2. The outward surface of the transitional portion 24*c* of the elastic plate 20*c* is therefore stopping against the inward periphery of the circular socket 11*c* (see FIG. 9).

Figure 10:
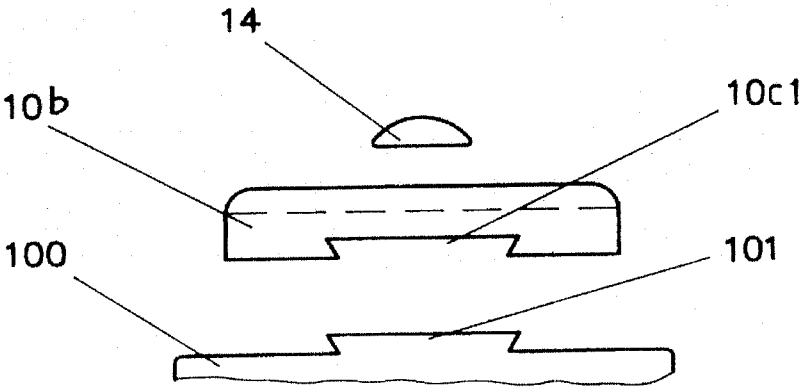
FIG. 10 is a cross sectional view to show a connection device in between a base of clip and an ornament.
Figure 9:
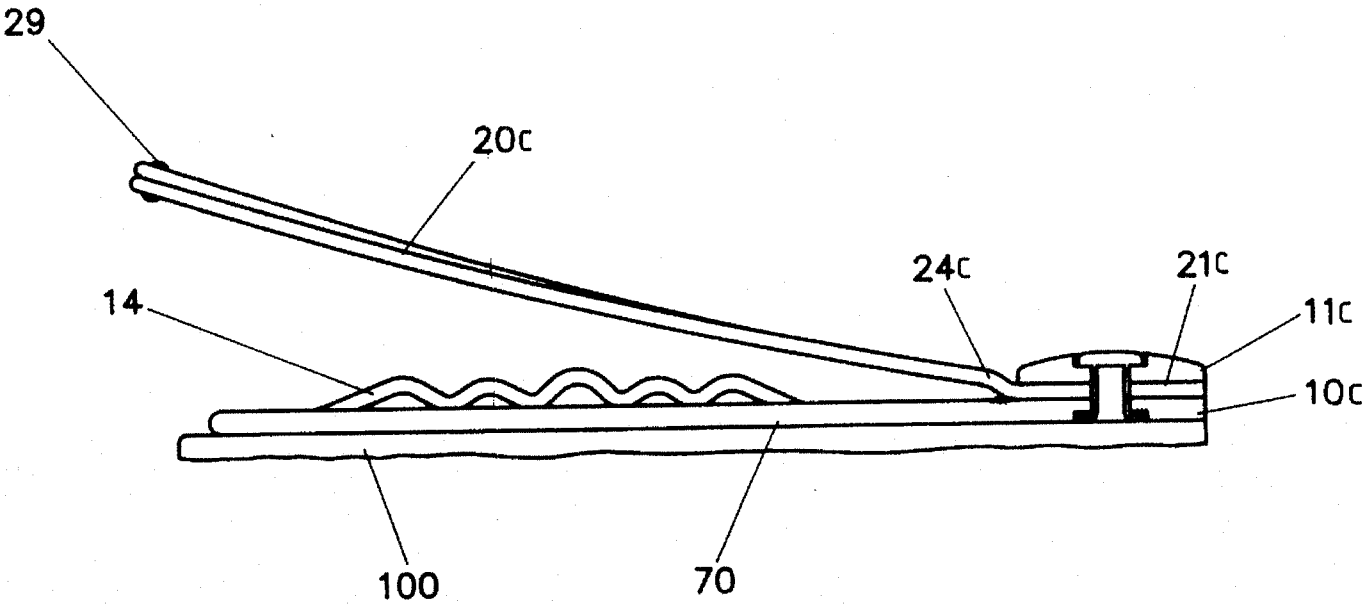
FIG. 9 is a sectional view of FIG. 8.

Referring to FIGS. 9 and 10, an ornament 100 is assembled onto the under side of the flat conical base 10*c* with a dovetail joint which is substantially adaptable to any of the previous examples. FIG. 10 shows a dovetail groove 10*c*1 formed along the longitudinal center line on the under side of the base 10*c* and a dovetail projection 101 formed in registry with, along the longitudinal center line on the back side of an ornament 100. When assembling, align first the dovetail projection 101 of the ornament 100 with the dovetail groove 10cl on the base 10*c*, then press the dovetail projection 101 into the dovetail groove loci to achieve a perfect connection.

Figure 11:
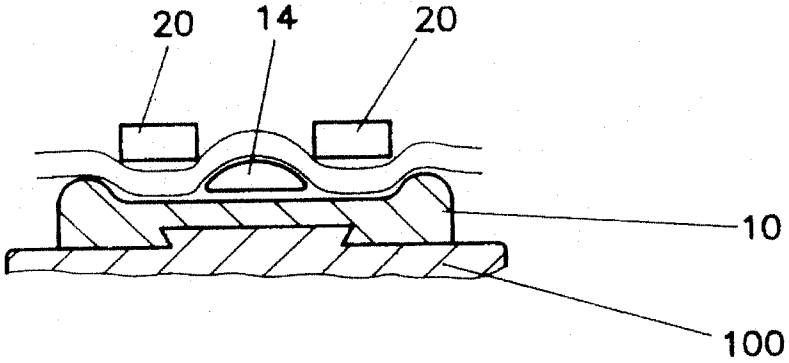
FIG. 11 is a cross sectional view to show an object being grasped by a ornamental clip of FIG. 1.
Figure 12:
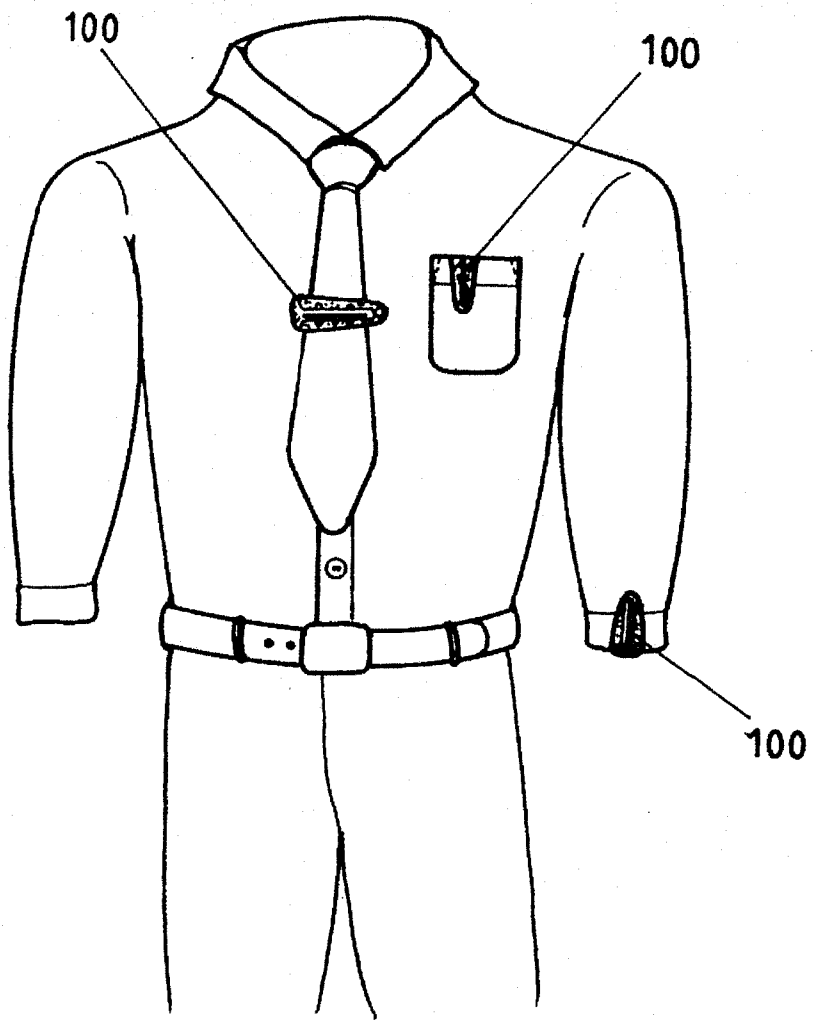
FIG. 12 is an elevational view to show an application of the ornamental clips on human dress.

Referring to FIG. 11, an object is clipped by an ornamental clip of this invention in a manner of crooked grasping which is rather effective than a parallel grasping by prior art. The corrugated rectangular plate 14 provides characteristically a great advantage in this invention. FIG. 12 shows a broader application of the ornamental clip of this invention to a brooch, a tiepin or cuff-links to provide the great cosmetic effect on human dress.

Based on aforediscussed examples, the present invention provides therefore the following advantages:

1) it provides simplified connection devices which can facilitate a ready assembly of a elastic plate with a base of an ornamental clip, 2) it is durable compared to the prior art because there is no any component in this disclosure worked depending upon the torque force. Furthermore, the components in this disclosure are dimensionally strong enough against a metal fatigue, 3) the grasping force applied on this disclosure comes vertically and evenly from the entire territory in addition to a corrugated rectangular plate which provides a manner of a crooked grasping to an object, this disclosure is thus more stable to grasp an object than the prior art, and 4) this disclosure is structurally and volumetrically adaptable to a lot of ornamental objects such as a brooch, a hairpin, a tiepin or cuff-links.

The scope of this invention should determined by the appended claims and their legal equivalents rather than by the examples given in the aforediscussed description.

I claim:

1. An ornamental clip comprising a, flat conical base and a corresponding elastic plate, wherein;

said flat conical base including a round head having attached on an under side of a semi-circular member having glossy surface, a corrugated rectangular plate secured on two ends into the respective ends of a longitudinal slot along the length of the flat conical base and a square socket formed on a flat end of the flat conical base projecting upward from the top surface of the flat end and having a horizontal slot extending along the axial direction of said Flat conical base and a pair of spaced rectangular recesses formed on an upper portion along the longitudinal center line of said socket;

said elastic plate comprising an elongated elliptical recess formed along the longitudinal center line thereof, a pair of three-point elastic centers formed adjacent the two ends of said elongated elliptical recess, a transitional portion extended from a flat end of the elastic plate and connected to a rectangular ping which is dimensionally corresponding to said horizontal slot of said square socket having a pair of cutaway corners and a pair of spaced rectangular spring snap catches formed on a surface of the plug along the longitudinal center line thereof, said rectangular spring snap catches being positionally and sizably made in registry with said pair of spaced rectangular recesses on the upper portion of said square socket;

whereby, when said rectangular plug of said elastic plate inserted into said horizontal slot in said square socket of said flat conical base, said pair of spaced rectangular spring snap catches are first pressed downwardly by the upper portion of said square socket and then spring upward and catch in said pair of spaced rectangular recesses on said upper portion of said square socket when said rectangular plug is completely secured in place inside said horizontal slot and then the outward side of said transitional portion of said elastic plate stops against the inward side of said square socket.

2. An ornamental clip according to claim 1, wherein said corrugated retangular plate of said flat conical base has been a plurality of continuous archs of different curvature in which the middle arch has a largest sectional area and the sectional areas of other archs are laterally and progressively reduced.

3. An ornamental clip according to claim 1, wherein said pair of three-point elastic centers on said elastic plate has been pressed into dimples to provide adequate resilience to the arms of said elastic plate.

4. An ornamental clip according to claim 1, wherein said elastic plate has a flat end portion connected with a hook shape plug having said pair of spaced rectangular spring snap catches thereon the upward surface of it's lower portion heading to the rear side of said elastic plate.

5. An ornamental clip according to claim 1, wherein said flat conical base and said elastic plate can be combined into an interlocking ornamental clip adaptable to a hairpin.

* * * * *